United States Patent [19]

Murano et al.

[11] 3,946,179

[45] Mar. 23, 1976

[54] VACUUM INTERRUPTER

[75] Inventors: Minoru Murano, Tokyo; Satoru Yanabu; Toru Tamagawa, both of Yokohama; Nobuyuki Takahashi, Kawasaki; Hiroyuki Okumura, Chigasaki; Hiroshi Ohhashi, Tokyo, all of Japan

[73] Assignee: Tokyo Shibaura Electric Co., Ltd., Kawasaki, Japan

[22] Filed: Sept. 10, 1974

[21] Appl. No.: 504,982

[30] Foreign Application Priority Data

| | | |
|---|---|---|
| Sept. 10, 1973 | Japan | 48-101870 |
| Mar. 13, 1974 | Japan | 49-28092 |
| Mar. 13, 1974 | Japan | 49-28093 |
| Apr. 5, 1974 | Japan | 49-38690 |
| May 28, 1974 | Japan | 49-61044[U] |
| June 20, 1974 | Japan | 49-72342[U] |

[52] U.S. Cl. ..... 200/144 B

[51] Int. Cl.[2] ..... H01H 33/66

[58] Field of Search ..... 200/144 B

[56] References Cited

UNITED STATES PATENTS

| | | | |
|---|---|---|---|
| 3,622,724 | 11/1971 | Sofianek | 200/144 B |
| 3,764,764 | 10/1973 | Takasuna et al. | 200/144 B |
| 3,818,164 | 6/1974 | Mizutani et al. | 200/144 B |
| 3,852,555 | 12/1974 | Schuocker et al. | 200/144 B |

*Primary Examiner*—Robert S. Macon

*Attorney, Agent, or Firm*—Finnegan, Henderson, Farabow & Garrett

[57] ABSTRACT

A vacuum interrupter includes a small-sized, light-weight, rigid coil electrode located behind a main electrode having a plurality of straight slits provided therein and extending from the periphery toward the central portion thereof, wherein magnetic field is created in a direction perpendicular to the surface of the main electrode by arc current flowing through the coil electrode, thereby causing arc produced on the surface of the main electrode to be uniformly and stably distributed, while preventing weakening of the magnetic field by arc current flowing along the surface of the main electrode and eddy current developed on the main electrode by the magnetic field.

8 Claims, 37 Drawing Figures

VACUUM INTERRUPTER

This invention relates to a vacuum interrupter, and more particularly to an improved vacuum interrupter having a pair of main electrodes and a coil electrode effective to create magnetic field in a direction perpendicular to the electrode surface of the main electrode, the main electrode being effective to prevent the magnetic field from being weakened by arc current and eddy current both flowing through the main electrode.

A pair of main electrodes are generally kept in contact with each other when load current is flowing through a vacuum interrupter. Where at this time the main electrodes are moved away from each other by a suitable operation mechanism, there occurs an arc between the main electrodes which is maintained by plasma emitted from a cathode. In an ordinary case, the occurrence of plasma is stopped when electric current comes to a zero. Therefore, the arc can not be maintained and electric current is interrupted. Where, however, large load current flows, an intense arc occurs. In this case, a resultant magnetic field consisting of a magnetic field created by the arc per se and magnetic fields created by the other circuits (for example, exterior conductors to which each of a pair of current carrying rods is connected) acts on the arc per se to render it unstable. This causes the arc to be localized at the periphery, or its neighborhood, of the electrode surface, causing the corresponding electrode surface portion to be locally overheated to produce a large amount of plasma. As a result, the degree of vacuum within a vacuum receptacle is lowered and thus an interrupting capability is lowered.

To avoid such disadvantages attempts have been made to make the surface of a main electrode wider to cause the density of electric current to be lowered or to provide spiral cuts in the surface of the main electrode to cause arc to be moved outward along the spiral groove. In the former case, there is still the possibility that arc will be localized at the peripheral surface of the main electrode, while in the latter case arc cannot be uniformly distributed over the entire surface of the main electrode. In either case, it is impossible to obtain a stable, uniformly distributed arc.

Where plasma escapes outward from between the main electrodes no sufficient plasma to maintain the arc in a stable way is obtained, the surface of the main electrode is locally overheated with the resultant localized fusion. That is, when a plasma between the main electrodes is escaped as mentioned above, arc voltage is raised so as to maintain electric current. As a result, a large amount of energy is supplied to the main electrode to cause the main electrode to be locally overheated or locally fused.

To prevent such phenomenon, it is known to apply magnetic field in a direction perpendicular to the surface of the main electrode. It is said that electrons, neutral atoms and ionized atoms are emitted at a ratio of about 100:10:1 from the cathode spot of arc. Out of these, the electrons and ionized atoms are necessary to maintain arc. Magnetic field applied in a direction perpendicular to the surface of the main electrode traps electrons and ionized atoms to prevent them from being dispersed outward from between the electrodes.

When electrons are so trapped between the main electrodes, electrons escaping outward from between the main electrodes are decreased to render arc stable.

The movement of electrons causes the travel of electrons to the anode to be extended. During the travel of electrons to the anode the probability that the electrons cause neutral atoms to be ionized is increased, thus replenishing deficient plasma to render arc stable. The ionized atoms moving toward the cathode also serves to render arc stable. In this way, arc is defined, under the influence of magnetic field, within between the electrodes.

In an attempt to apply a magnetic field in a direction perpendicular to the surface of a main electrode, an exciting coil is provided around the outer periphery of a vacuum vessel and connected between the main electrodes and a current carrying rod, or the portion of the current carrying rod is wound in the form of a coil within a vacuum vessel and is connected to the main electrode. In the former case, however, it is difficult to obtain a magnetic field exhibiting a sufficient effect, since the exciting coil and electrode are spaced far away from each other. Furthermore, a fairly large-sized exciting coil is required, resulting in an expensive, bulky and weighty vacuum interrupter. In the latter case, the current carrying rod is complicated in construction and difficult to manufacture. Moreover, an inner construction becomes bulky and a vacuum interrupter as a whole becomes weighty and large-sized.

It is also observed that, when magnetic field is created in a direction perpendicular to the surface of the main electrode, eddy current is developed in the main electrode due to the magnetic field to cause the main electrode to be overheated or a magnetomotive force created by the eddy current causes the magnetic field to be weakened.

It is accordingly the object of this invention to provide a vacuum interrupter free from drawbacks as encountered in the prior art, in which a rigid, compact and light-weight coil electrode and a pair of main electrodes are provided, the coil electrode serving to cause magnetic field to be created in a direction perpendicular to the electrode surface of the main electrode to render stable and uniform an arc confined between the main electrodes, while the main electrode serves to decrease the generation of eddy current flowing through the main electrode and restrict the flow of arc current flowing through the main electrode, thereby preventing the magnetic field to be weakened due to the eddy current and arc current.

To attain this object, there is provided a vacuum interrupter comprising a vacuum vessel; a pair of current carrying rods arranged in a manner aligned with each other and having one end extending into the interior of the vacuum vessel, at least one of said current carrying rods being axially movable; a pair of main electrodes each connected to the end of the current carrying rod and having a plurality of slits extending from the periphery toward the center thereof; a coil electrode connected between the main electrode and the current carrying rod; the coil electrode comprising a plurality of first conductors extending substantially radially from the central portion thereof to permit currents branched from arc current to flow toward the periphery thereof, a plurality of second conductors arcuately extending in the same direction from the forward end of the first conductor toward the forward end portion of the adjacent first conductor with a space left therebetween and a plurality of third conductors extending from the free end of the second conductor and connected to the main electrode; said first, second and third conductors being effective to create a magnetic field in a direction perpendicular to the electrode surface of the main electrode by the branched currents flowing therethrough; said slits being effective to reduce eddy current to be developed on the surface of the main electrode by the magnetic field while leading the branched currents on the main electrode to flow through the center portion of the main electrode, thus preventing the magnetic field from being weakened by the eddy current and branched currents.

This invention will be further described with reference to the accompanying drawings, in which.

The embodiment of this invention will be explained by referenece to the accompanying drawings.

Figure 1B:
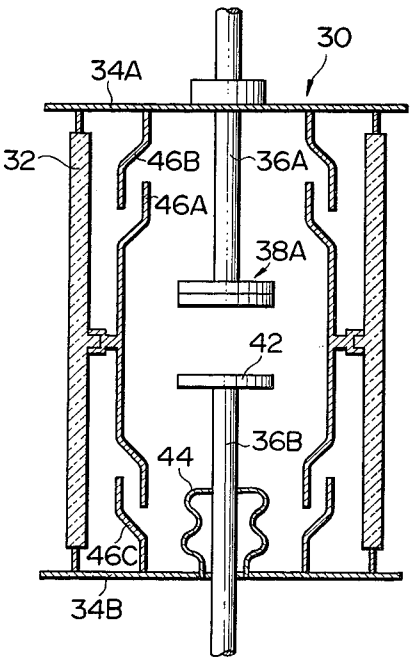
FIG. 1B is a partial, cross-sectional view showing the construction of another vacuum interrupter.
Figure 1A:
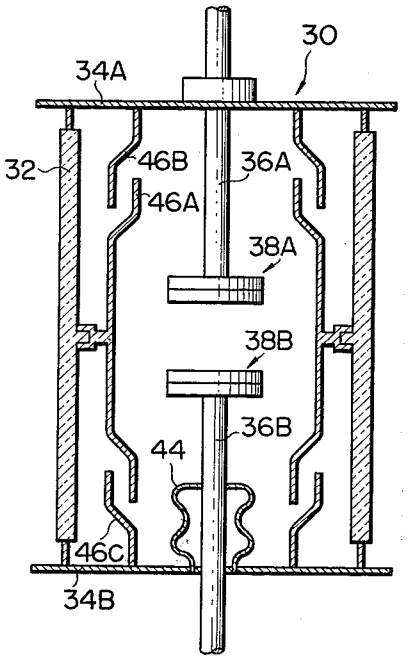
FIG. 1A is a partial, cross-sectional view showing the construction of a vacuum interrupter.

FIG. 1A shows a vacuum interrupter according to one embodiment of this invention, in which a vacuum vessel 30 has a cylindrical body 32 made of an insulating material and upper and lower closures 34A and 34B, and composite electrodes 38A and 38B are mounted to the free ends of current carrying rods 36A and 36B, respectively, which extend through the upper and lower closures, respectively. The current conducting rod 36B and thus the composite electrode 38B are driven by an operation mechanism (not shown) so as to cause it to be reciprocably moved into and out of contact with the associated composite electrode 38A to permit the load current of the vacuum interrupter to be passed or interrupted. When arc occurs between the electrodes 38A and 38B, arc current flows through the current carrying rods 36A and 36B. The up and down movement of the current carrying rod 36B is effected through a bellows 44 so that the vacuum of the vacuum vessel is maintained. Reference numerals 46A–46C each represents a shield surrounding the composite electrodes 38A and 38B. The composite electrodes 38A and 38B are substantially identical in structure with each other and an explanation is, therefore, restricted only to one composite electrode 38A.

Figure 3A:
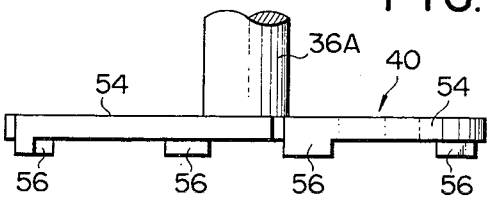
FIGS. 3A and 3B are a front view and a plan view, respectively, showing a coil electrode associated with the composite electrode shown in FIGS. 2A and 2B.
Figure 3B:
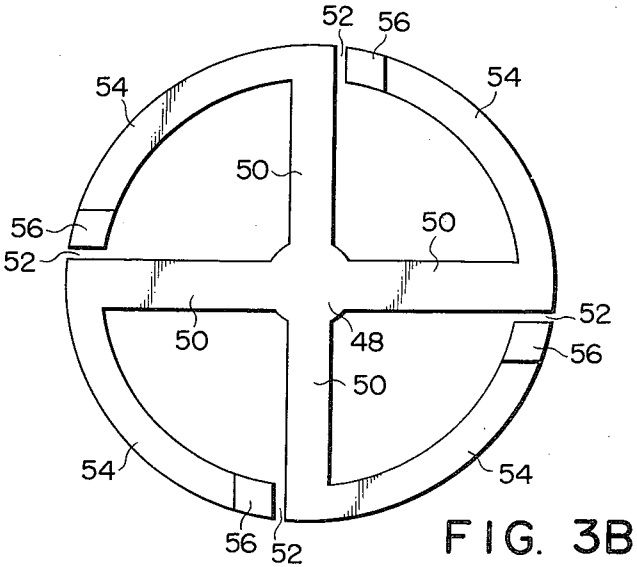
Figure 2A:
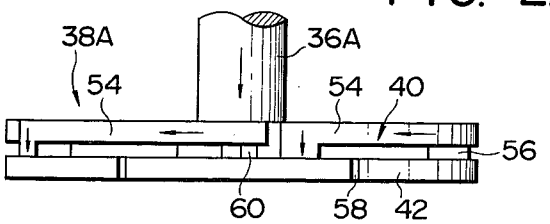
FIGS. 2A and 2B are a front view and a plan view, respectively, showing one embodiment of a composite electrode.
Figure 2B:
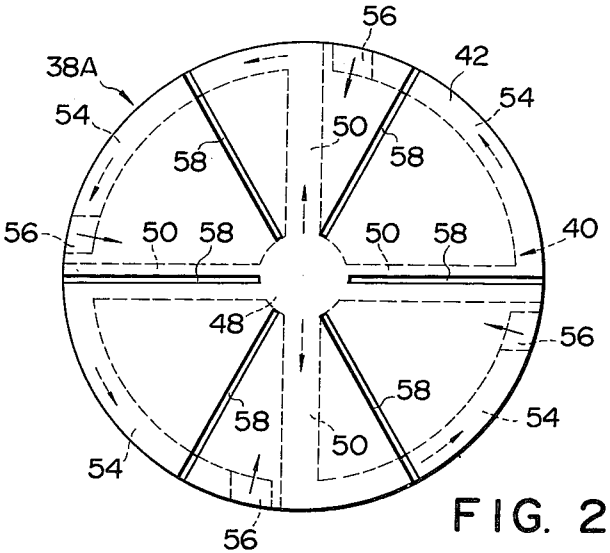
Figure 4:
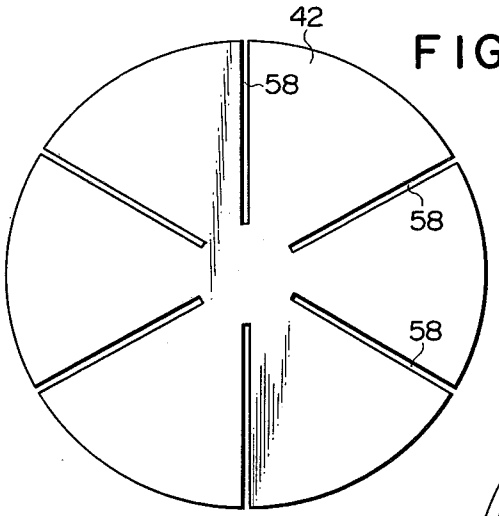
FIG. 4 is a plan view showing one example of the main electrode.
Figure 5:
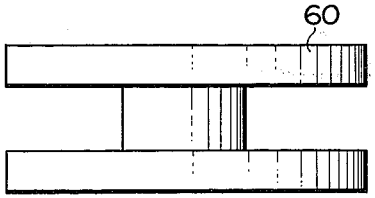
FIG. 5 is a plan view showing one example of a spacer.

FIGS. 2A and 2B show the composite electrode 38A. The composite electrode 38A includes a coil electrode 40 and a main electrode 42. FIGS. 3A and 3B show the coil electrode 40. The coil electrode 40 comprises first conductors (in this case, arms 50) having a circular mounting section 48 mounted to the free end of the current carrying rod 36A and extending in four directions; second four conductors (in this case, arcuate sections 54) extending in the same direction with a clearance 52 left between the free end thereof and the adjacent arm 50, and along a circle described with the current carrying rod 36A as a center; and third conductors (in this case, projections 56) projecting from the free end portion of the arcuate section and on the side opposite to the side on which the current carrying rod 36A is present. The main electrode 42 is a circular member having substantially the same outer diameter as that of the coil electrode 40 and has six slits 58, as shown in FIG. 4, which extend from the outer periphery thereof toward the central portion thereof. As shown in FIGS. 2A and 2B, the main electrode 42 is mounted on the side opposite to the side on which the projections 56 of the coil electrode are provided. The mounting of the main electrode 42 to the coil electrode 40 is effected with a spacer 60 centrally located therebetween and with the four projections 56 abutted against the main electrode 42. The current carrying rod 36A, coil electrode 40, projections 56 are all made of copper and main electrode 42 are made of copper alloy, and connection between the current carrying rod 36A and the coil electrode 40 and connection between the projections 56 and the main electrode 42 are effected so as to have a low electric resistance. The spacer is rigidly mounted between the coil electrode 40 and the main electrode 42 so as to have a high electrical resistance. For this reason, the spacer 60 is made of a mechanically rigid, high electrical resistive material such as stainless steel. As shown in FIG. 2A, the main electrode 42 is so coupled to the coil electrode 40 that at least one slit is disposed between the projections 56 of the coil electrode 40 and any slit 58 is not spanned with the projection 56 of the coil electrode 40. Therefore, the number of slits 58 may be equal to, or greater than, the number of the arms 50 of the coil electrode 40. FIG. 5 shows one form of the spacer 60 by way of example.

With the vacuum interrupter so constructed, when the current carrying rod 36B is opened, by the operating mechanism (not shown), to cause the electrode 38B to be moved out of engagement with the electrode 38A, arc is generated between the electrodes 38A and 38B. As shown in FIGS. 2A and 2B, arc current flows from the current carrying rod 36A ino the coil electrode 40. That is, the arc current is branched into substantially equal currents and flows from the mounting section 48 through the four respective arms 50 to the four respective arcuate sections 54 and then through the respective projections 56 into the main electrode 42, as indicated by arrows.

Since the electric current flows through the four individual arcuate sections 54, a magnetic field created, as a whole, by the branched currents in a direction perpendicular to the electrode surface of the main electrode 42 is substantially equal to a magnetic field created by causing the branched current flowing through the respective arcuate sections 54 to be passed through an imaginative coil of one turn which is obtained by connecting together the respective arcuate sections. The electrode current so flowing into the main electrode 42 further flows through arc into the other electrode 38B where a magnetic field is created in the same manner as the electrode 38A. The magnetic field is created between both the electrodes 38A and 38B confines the arc and prevents an escape of plasma from the arc with the result that no insufficient plasma is involved. Consequently, the arc is stably and uniformly distributed over the surface of the main electrode 42, leading to the improved interrupting capability of the vacuum interrupter.

However, the magnetic field so created is weakened by the electric current to cause the interrupting capability of the vacuum interrupter to be reduced. In an attempt to avoid such drawback, the slits 58 are provided in the main electrode 42.

The magnetic field is caused to be weakened, for example, by the following electric currents:

1. An eddy current flows through the main electrode 42 to create magnetic field opposite in direction to the above-mentioned magnetic field, thereby weakening the latter magnetic field. Since the slits 58 are provided in a direction to traverse a path through which the eddy current flows, occurrence of eddy current is restricted, thus preventing the above-mentioned magnetic field from being weakened.

2. Out of branched currents flowing from the coil electrode 40 through the respective projections 56 into the main electrode 42, some flows through the main electrode 42 in a direction anti-parallel to the direction in which the electric current flows through the arcuate sections 54 of the coil electrode 40. This branched current serves to weaken the above-mentioned magnetic field.

Figure 6:
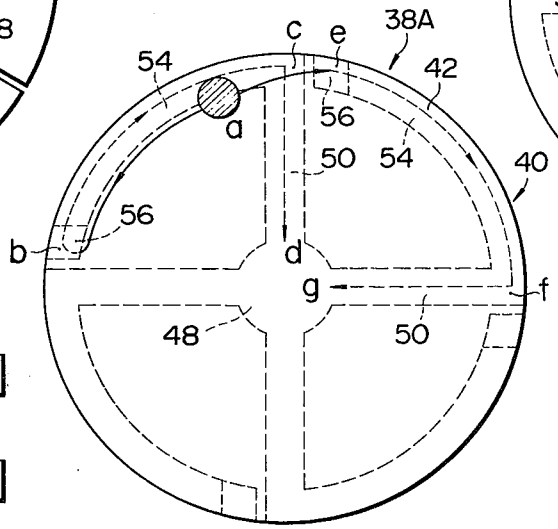
FIG. 6 is a front view for explaining the path of arc current flowing through a main electrode having no slits.

The current mentioned in (2) will be explained below in more detail by reference to FIGS. 6 and 7. For brevity of explanation, FIGS. 6 and 7 show the case where arc current flows through the main electrode 42, arc current is branched into four currents and further flows through the four projections 56 into the coil electrode 40.

Even if the electric current is opposite in sense, the same cancelling effect of magnetomotive force as will be explained later will be presented. FIG. 6 shows the case where arc is generated at a hatched circular portion a of the main electrode having no slit and the arc current flows through the portion a into the main electrode 42. The arc current is then branched into four currents, flows through the projections 56 and then through the respective arcuate sections 54 in the same sense, and is collected through the respective arms 50 into the mounting section 48 of the coil electrode 40 where it is further directed toward the current carrying rod. A magnetic field created on the electrode surface of the main electrode by the four branched currents flowing through the respective four arcuate sections 54 is substantially equal to a magnetic field created by causing a branched current to flow through an imaginative coil of one turn which is obtained by connecting the respective arcuate sections together. As already set out above, this magnetic field is weakened by arc current flowing through the surface of the main electrode 42. Let us now show representative two of the four branched currents flowing through the four projections 56. One branched current flows counterclockwise from the portion a through the periphery section of the main electrode 42 to the projection 56 indicated by b and then turned back into the arcuate section 54 in a clockwise direction and flows through a point c and then through the arm 50 in a direction of d into the current carrying rod. The other branched current flows clockwise from the portion a to the projection 56 indicated by e and then clockwise through the arcuate section 54 to a point f where it further flows through the arm 50 in a direction of *g* into the current carrying rod.

In the current path *a–d*, the sub-paths *a–b* and *b–c* are close to each other, and the branched current flowing counterclockwise through the sub-path *a–b* and the branched current flowing clockwise through the sub-path *b–c* cancel each other. As a result, magnetomotive forces induced at the corresponding arcuate section 54 almost cancel each other, causing a magnetic field created perpendicular to the main electrode to be weakened. In the other current path *a–e–f–g* no such cancellation effect is involved.

Figure 7:
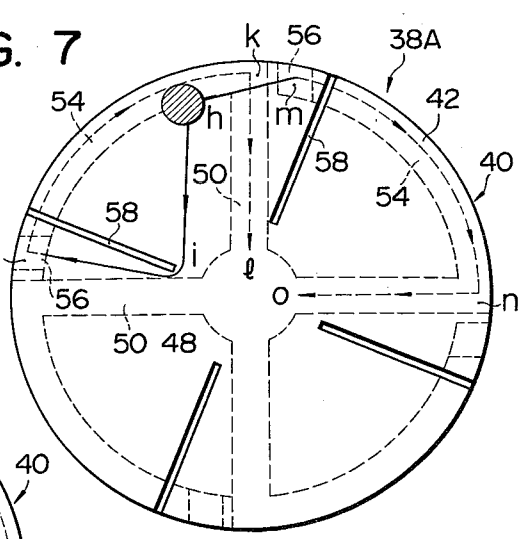
FIG. 7 is a plan view for explaining the path of arc current flowing through a main electrode having slits.

In the composite electrode 38A shown in FIG. 7, four slits 58 are provided in the main electrode 42. These four slits 58 are located in a position clockwise displaced a little from the respective projectors 56 and extend rectilinearly from the periphery of the main electrode 42 toward the central portion thereof. In general, it is necessary that the number of slits 58 be equal to, or greater than, the number of projections 56. These slits 58 are so arranged that at least one slit 58 is present between the projections 56 and that any of these slits is not spanned with the projection 56. A hatched portion *h* is a location where arcing is produced.

One arc current branched flows from the portion *h* into the main electrode 42, i.e., through the inner extremity *i* of the slit 58 into the projection 56 shown at *j*, then through the arcuate section 54 to a forward end *k* of the arm, and finally through the arm 50 in a direction of *l* to the mounting section 48, the path of which is hereinafter referred to as a first path. The other branched current flows from the portion *h* into the projection 56 shown at *m*, then through the arcuate section 54 to a forward end *n* of the arm 50 and finally through the arm 50 in a direction of *o* to the mounting section 48, the path of which is hereinafter referred to as a second path. Since the first path is long while the second path is short, the branched current flowing through the second path is greater than the branched current flowing through the first path. Since the branched current passing through the first path, unlike the flow of arc current shown in FIG. 6, flows from the portion *h* through the portion *i* near to the central portion of the main electrode into the projection *j*, a magnetomotive force created by the branched current flowing through the arcuate section 54 is less subject to cancellation. On the other hand, the branched current flowing through the second path is subject to no cancellation. Since the branched currents passing through the other two projections 56 flow through the respective extremities of the respective slits 58, magnetomotive forces created at the corresponding arcuate sections 54 are subject to less cancellation.

As will be evident from the foregoing explanation, provision of slits 58 in the main electrodes 42 prevents the above-mentioned magnetic force from being weakened by eddy current as well as by arc current flowng through the main electrode 42. This assures a high interrupting capability of a vacuum interrupter. To obtain a full current interrupting capability the slit is so dimensioned as to have a length corresponding to 50–70% of the radius of the main electrode 42 and as many slits as can be allowed from the designing consideration are provided in the main electrode.

With the composite electrode 38A, the coil electrode 40 simple in construction is located immediately behind the main electrode 42 to permit magnetic field to be created on the electrode surface of the main electrode 42, and, since the main electrode 42 is provided so as to prevent magnetic field from being weakened by the above-mentioned unwanted electric currents flowing through the main electrode, the coil electrode 40 may be easily formed in compact form, resulting in a light-weight compact vacuum interrupter exhibiting a high interrupting capability.

The coil electrode 40 and the main electrode 42 which, together, constitute the composite electrode 38A may take a variety of forms as will be explained below.

Figure 8A:
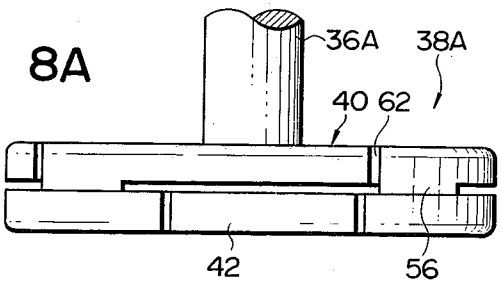
FIG. 8A is a front view showing another composite electrode.
Figure 8B:
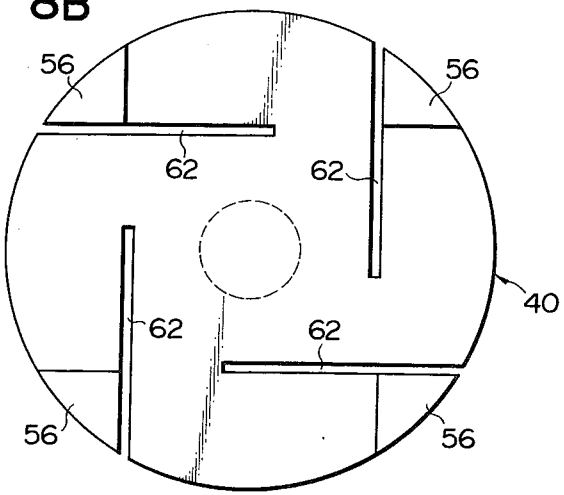
FIG. 8B is a plan view of a coil electrode shown in FIG. 8A.

In a composite electrode 38A shown in FIGS. 8A and a coil electrode 40 shown in FIG. 8B, a coil electrode 40 has four straight slits 62. These slits 62 are cut to equal length and are open at its periphery of the coil electrode and are spaced equidistantly away from the center of the coil electrode and at right angles to each other with four arcuate sections left therebetween. Projections 56 are provided at those acute-angled extreme portions of the arcuate sections of the coil electrode which are located adjacent to the open ends of the slits 62. Each projection 56 of the coil electrode 40 is connected, upon assembly, to the main electrode 42. Electric current from the current carying rod 36A radially flows along arcuate sections of the coil electrode 40 and then through the respective projections 56 into the main electrode 42. This simple coil electrode 40 can be easily formed merely by cutting four straight slits so that those sections corresponding to the arms 50 and arcuate sections 54 shown in FIGS. 2A and 2B are simultaneously provided.

Figure 9:
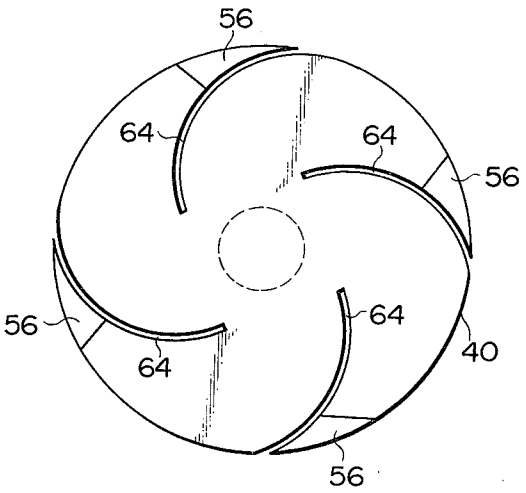
FIG. 9 shows a plan view of another coil electrode having spiral slits.

A coil electrode 40 shown in FIG. 9 has four spiral slits 64 curvilinearly extending in the same directions and open at its periphery with four arcuate sections left therebetween. Projections 56 are provided at those acuteangled extreme portions of the arcuate sections of the coil electrode 40 which are located adjacent to the open ends of the slits 64. Each projection 56 of the coil electrode 40 is connected, upon assembly, to the main electrode (not shown). Electric current from the current carrying rod (not shown) is branched into four currents and the branched currents radially flow along the arcuate sections of the coil electrode 40 and then through the respective projections 56 into the main electrode. In this case, the arcuate section between the slits 64 serves as the arm 50 and arcuate section 54 shown in FIGS. 2A and 2B.

The pair of composite electrodes 38A, 38B may be provided as shown in FIG. 1A or a single composite electrode (for example, 38A) may be provided as desired as shown in FIG. 1B.

With the vacuum interrupter, since the movable current carrying rod is connected through a flexible conductor to a bus, a heat generated within the interrupter is poorly dissipated. The fixed current carrying rod is connected through a large clamp to a bus and, therefore, a heat generated with the interrupter is better dissipated. The composite electrode generates a greater amount of heat due to the presence of the coil electrode than a main electrode. Where a composite electrode and a main electrode are used in a pair in the vacuum interrupter, it is advised that the composite electrode 38A be connected to the fixed current carrying rod 36A while the main electrode 42 be connected to the movable current carrying rod 36B. This arrangement assures a balanced heat dissipation and permits a raise in temperature to be kept to lower level.

The coil electrode 40 can create a magnetic field substantially equal to a magnetic field created by causing the branched current flowing through the arcuate section of the coil electrode to flow through an imaginative coil of one turn which is obtained by connecting the respective arcuate sections together. Where it is desired to alter the intensity of the magnetic field, it is almost achieved by varying the number of arcuate sections 54. With I representing an electric current flowing through the current carrying rod 36A, an electric current flowing through the arcuate section 54 will become I/4. If the arcuate sections are provided in numbers of 2, 3 ..... *n*, then a magnetic field to be created on the coil electrode will have an intensity corresponding to 4/2, 4/3 ..... 4/*n* times, respectively.

The shape, number and position of slits 58, as well as the position at which the projections 56 are connected to the main electrode, may be varied as will be later described.

Figure 11A:
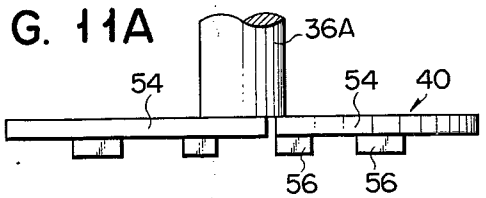
FIGS. 11A and 11B are a front view and a plan view showing a coil electrode used in the composite electrode shown in FIGS. 10A and 10B.
Figure 11B:
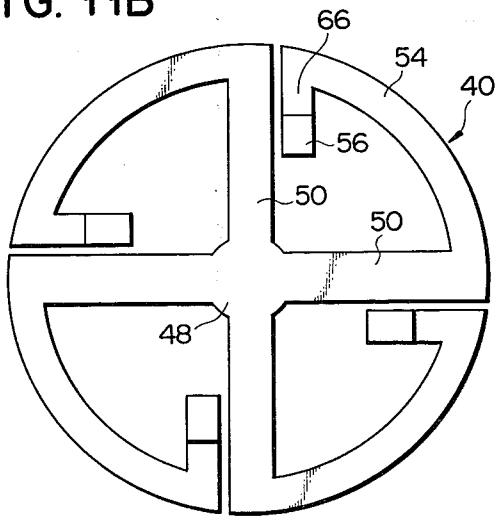
Figure 10A:
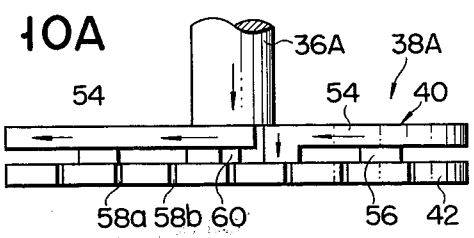
FIGS. 10A and 10B are a front view and a plan view showing another composite electrode.
Figure 10B:
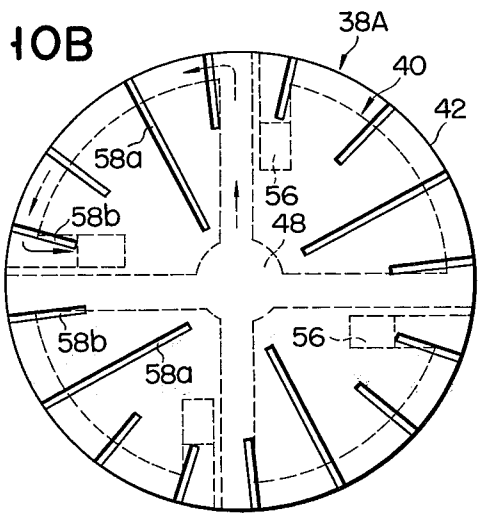

FIGS. 10A and 10B show a composite electrode 38A in which a coil electrode 40 shown in FIGS. 11A and 11B is employed. The shape of slits 58a and 58b provided in a main electrode 42 is clearly shown in FIG. 10B. As shown in FIG. 11B, a third conductor for connecting the projecting ends of arcuate sections 54 to the main electrode 42 consists of sections 66 extending parallel to adjacent arms 50 and projections 56 extending from the free end portion of the section 66 toward the main electrode 42. Respective branched currents flowing through the respective arcuate sections 54 of the coil electrode 40 flow, through the respective projections 56 directed from the marginal portion toward the central portion of the main electrode, into the main electrode 42. The slit 58 consists of the equi-angularly arranged four relatively long, straight slits **58*a* and four sets of slits 58*b*, each set being comprised of three short, straight slits arranged between the straight slits 58*a*. Each projection 56 is positioned between the slits 58*a* and is connected, in a position nearer to the central portion of the main electrode than the short slit 58*b*, to the main electrode 42. The projections 56 are so arranged that any of slits 58*a* and 58*b* is not spanned with the respective projection 56. The coil electrode 40 and slits 58*a*, 58*b* of the composite electrode 38A** are similar in operation and effect to the counterparts of the composite electrode shown in FIGS. 2A and 2B. With the composite electrode 38A shown in FIGS. 10A and 10B, a plurality of slits 58*a*, 58*b* have the advantage of suppressing the generation of eddy current. Furthermore, no current branched from arc current flows along the arcuate section 54 of the coil electrode 40 due to the presence of the plurality of slits 58*a*, 58*b* and due to the position in which the projections 56 are located. Even if arc occurs at any portion of the main electrode 42, the weakening of magnetic field by the above-mentioned currents if effectively prevented. As a result, arc is distributed, uniformly and in a stable way, over the electrode surface of the main electrode 42. When the coil electrode 40 and the main electrode 42 are employed in a pair in the vacuum interrupter, the associated composite electrodes are so connected to the respective current carrying rods 36A and 36B that the slits 58*a* of one main electrode align with the slits 58*a* of the other main electrode.

Figure 12:
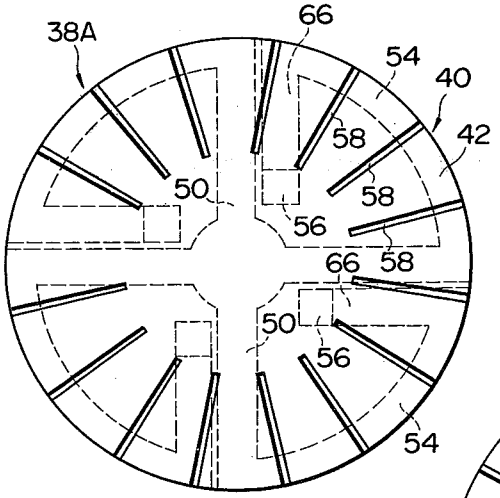

FIG. 12 shows a modified from of the composite electrode 38A shown in FIG. 10B. In this modification, those sections corresponding to the sections 66 of the coil electrode 40 shown in FIG. 11A are connected, in a position further extending toward the central portion of a main electrode 42, to the main electrode 42. Slits 58 of equal length are cut in the main electrode 42 and extend toward the central portion of the main electrode 42. This arrangement presents an improvement in effect over the arrangement in FIG. 10B.

Figure 13:
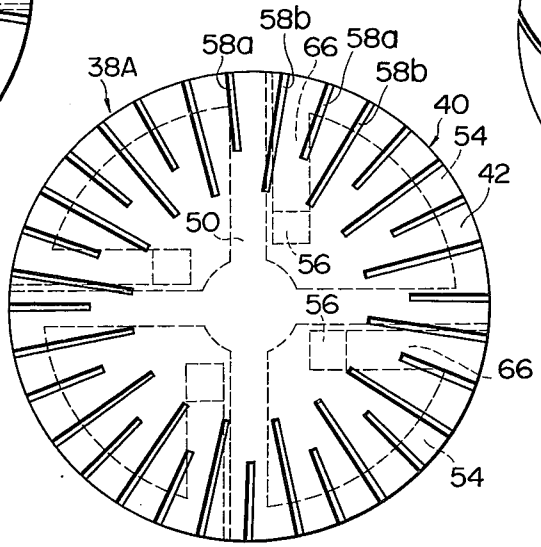

With a composite electrode shown in FIG. 13, projections 56 are located, like the modification shown in FIG, 12, close to the central portion of a main electrode. In a main electrode 42, long slits 58a and short slits 58b are radially arranged in an alternating fashion.

Figure 14:
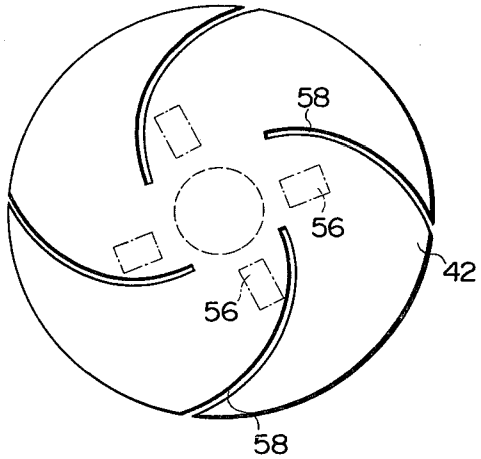
FIGS. 12 to 14 are plan views each showing another composite electrode.

FIG. 14 shows a main electrode 42 having spiral slits 58 extending in a curvilinear fashion. The main electrode 42, if used in combination with, for example, the coil electrode 40 shown in FIGS. 12 and 13, will exhibit the same effects as realized in the above-mentioned embodiments.

In the above-mentioned embodiments, the coil electrode, 40 is connected through the spacer 60 (FIGS. 2A and 5) or the projections 56 to the main electrode 42 with a gap left therebetween. The spacer 60 is usually made of a high mechanical strength, high resistance material such as stainless steel. In contrast, the electrode 40 is formed of copper and main electrode 42 is formed of copper alloy showing good electric conductivity and, therefore, have a low mechanical strength. When the vacuum interrupter is opened and closed, there arise the situations in which the coil electrode 40 is deformed due to impact forces imparted by the composite electrode 38A with the result that it partially contacts with the main electrode 42. In order to avoid such failure a reinforcing member may be disposed, together with the spacer 60, between the main electrode 42 and the coil electrode 40. As the reinforcing material use is made of stainless steel. By forming the spacer and reinforcing material using a high resistant material and making slender these members disposed between the main electrode 42 and the coil electrode 40, only a small amount of arc current is made to flow through these members. In other words, a great amount of arc current is made to flow through the projections into the coil electrode 40.

FIGS. 15A and 15B, 16A and 16B, 17A and 17B, 18A and 18B and 19A and 19B show composite electrodes in which reinforcing members are inserted.

Figure 15A:
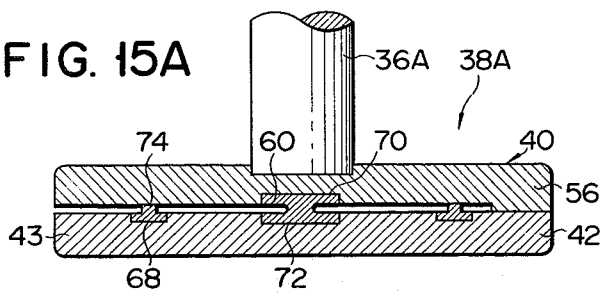
Figure 15B:
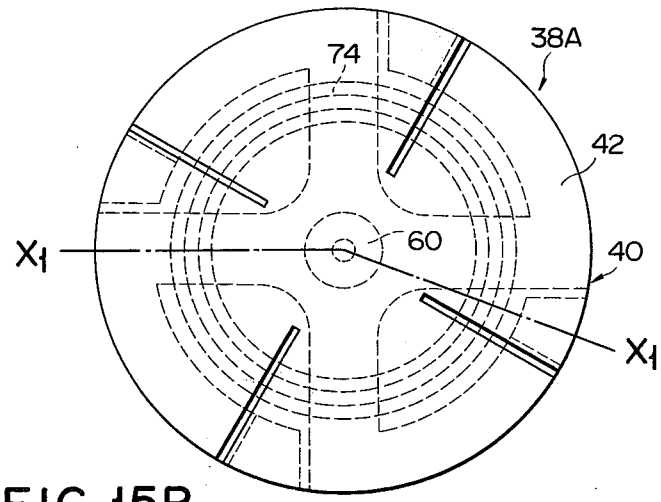

The composite electrode 38A shown in FIGS. 15A and 15B has at its central portion a spacer 60 located between a coil electrode 40 and a main electrode 42 and around the spacer 60 the reinforcing member 68 located in a spaced apart relation to the spacer 60. The spacer 60 is fitted at both ends into associated recesses 70 and 72 provided in the coil electrode 40 and main electrode 42, respectively. The spacer 60 is reduced in diameter at its intermediate portion so as to provide a high electrical resistance between the ends thereof. The reinforcing member 68 is ring-like in configuration and T-shaped in cross section and has one end fitted into the associated annular recess of the main electrode 42 and the other end 74 abutted against the surface of the coil electrode 40. The shape of the reinforcing member prevents the coil electrode 40 from being contacted with the main electrode 42 due to deformation. Since the reinforcing member 68 has the reduced wall portion, a high resistance is assured between the coil electrode 40 and the main electrode 42.

Figure 16A:
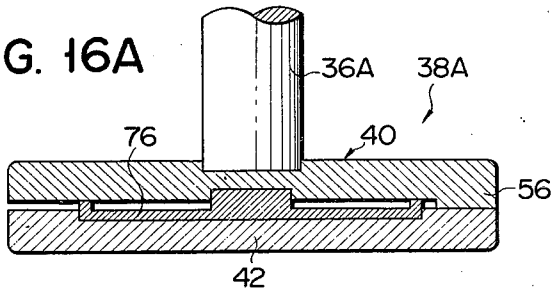
FIGS. 15–15B, 16A–16B, 17A–17B, 18A–18B and 19A–19B are front cross-sectional views and plan views, respectively, showing a composite electrode with reinforcing member, the front views being taken along $X_1$—$X_1$, $X_2$—$X_2$, $X_3$—$X_3$, $X_4$—$X_4$ and $X_5$—$X_5$ of the plan views, respectively.
Figure 16B:
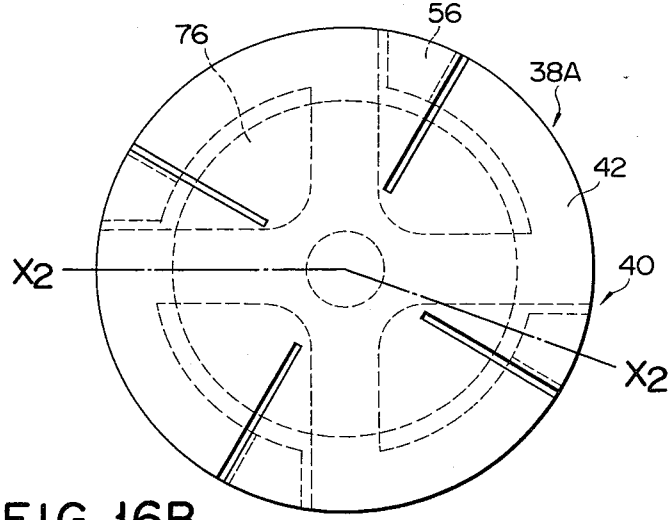

With the composite electrode 38A shown in FIGS. 16A and 16B, the reinforcing member 76 is formed integral with a spacer 60 shown in FIGS. 15A and 15B with an annular recess left around the spacer. The combination insert is embedded at one end in a main electrode 42. At the other end of the insert, the insert is fitted at the central portion into a coil electrode 40 and abutted at the annular marginal portion against the coil electrode.

Figure 17A:
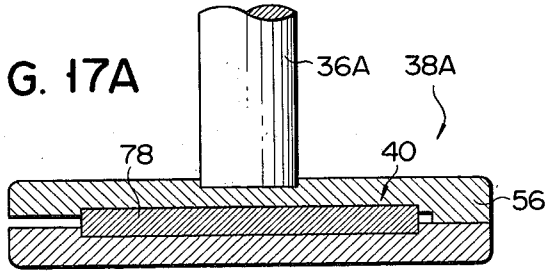
Figure 17B:
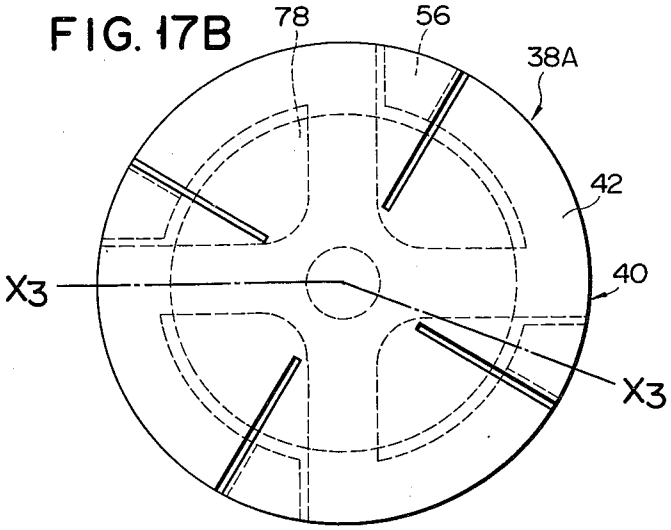

With the composite electrode shown in FIGS. 17A and 17B, the reinforcing member is formed integral with a spacer. This combination insert is disk-like in shape and simple in construction and easy to manufacture.

Figure 18A:
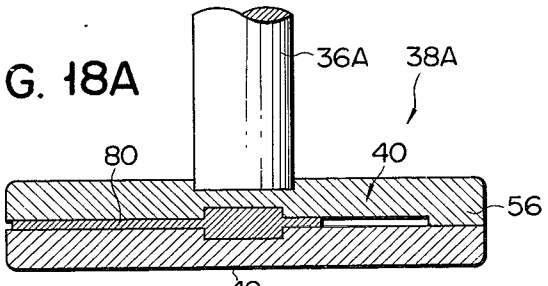
Figure 18B:
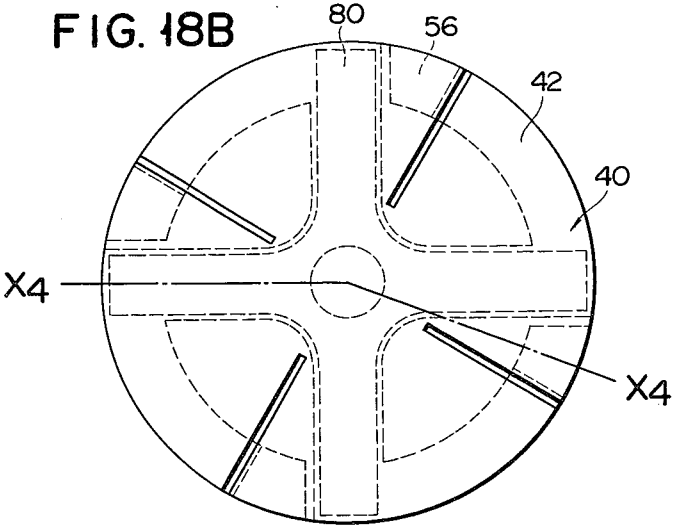

With the composite electrode 38A shown in FIGS. 18A and 18B the reinforcing member 80 is formed integral with a spacer. This combination insert is disposed between a main electrode 42 and a coil electrode 40 and has arms formed along the arms of the coil electrode 40. This combination insert 80 permits a saving of material used and is relatively simple in construction.

Figure 19A:
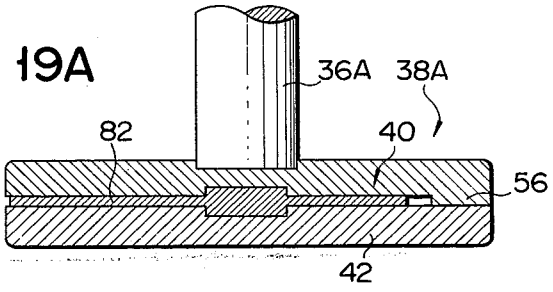
Figure 19B:
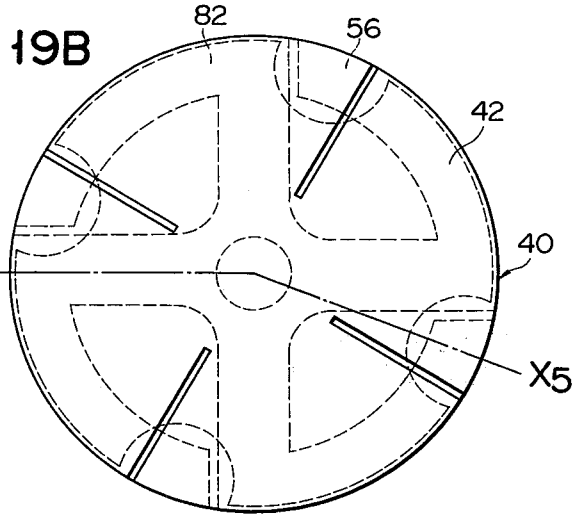

With the composite electrode 38A shown in FIGS. 19A and 19B the reinforcing material is formed integral with a spacer. This combination insert substantially wholly covers the surface of a coil electrode 40 or a main electrode 42 except that those portions corresponding to the projections 56 of the coil electrode 40 are semi-circularly cut out. The insert is effective to form the composite electrode 38A rigidly.

The other modification of the reinforcing member may be made. In any case, the use of these reinforcing members assures a durable vacuum interrupter capable of withstanding an impact load, an impact load tending to deform the coil electrode, imparted at the time of opening and closing the interrupter.

Figure 20:
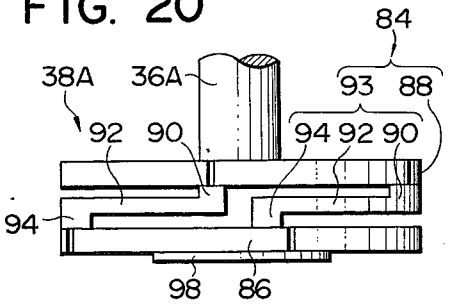
FIG. 20 is a front view showing another composite electrode.
Figure 21:
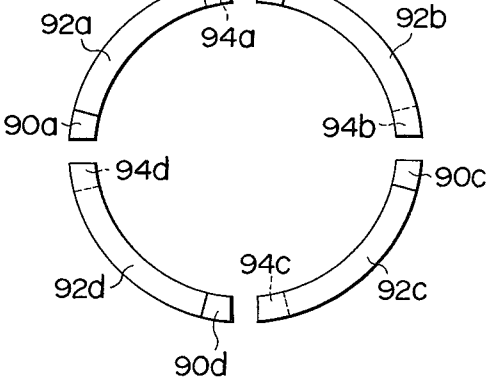
FIGS. 21, 22 and 23 are plan views showing a coil member, external electrode and main electrode shown in FIG. 20, respectively.
Figure 22:
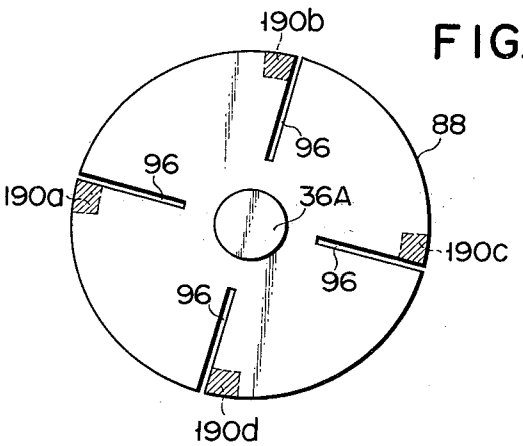
Figure 23:
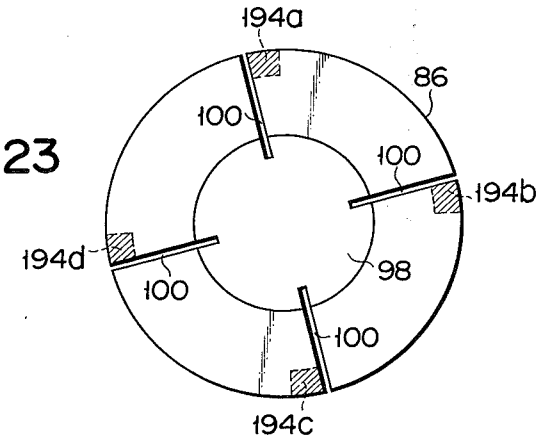

FIG. 20 shows another modification of the composite electrode 38A. This composite electrode 38A comprises a coil electrode 84, a main electrode 86 and a contact 98 provided on the electrode surface of the main electrode 86 so as to prevent the main electrode 86 from being locally welded. The coil electrode 84 has an external electrode 88 and coil member 93 each consisting of an arcuate section 92 extending in the same direction in a parallel relation to the external electrode 88, a first projection 90 extending from one end portion of the arcuate section and connected to the external electrode 88, and a second projection 94 extending from the other end portion of the arcuate section 92 and connected to the main electrode 86. In this embodiment, the arcuate sections 92 are four in number. FIG. 21 shows the shape and position of first projections 90*a* to 90*d*, arcuate sections 92*a* to 92*d* and second projections 94*a* to 94*d*, all of which are disposed between an external electrode 88 and a main electrode 86. FIG. 22 is a plan view showing the external electrode 88, while FIG. 23 is a plan view showing the main electrode 86. FIGS. 21 to 23 are views as viewed from the side of the current carrying rod 36A. These members are assembled in a direction shown. The external electrode 88 shown in FIG. 22 has four straight slits 96 which are equiangularly arranged and extend toward the center thereof. In FIG. 22, shaped rectangles 190*a* to 190*d* counterclockwise described adjacent to the open end of the slit indicate the position in which the first projections 90*a*–90*d* are connected to the external electrode 88. The main electrode 86 of FIG. 23 has four straight slits 100 which are equiangularly arranged and extend toward the center thereof. In FIG. 23, shaded rectangles 194*a* to 194*d* clockwise described adjacent to the open end of the slit indicate the position in which the second projections 94*a* to 94*d* are connected to the main electrode 86. In FIGS. 21 to 23, reference numerals bearing suffixes *a* to *d* are employed to facilitate an understanding of the detailed arrangement of the composite electrode 38A. The external electrode 88 is mounted on the forward end of the current carrying rod 36A. The coil members 93 are disposed between the external electrode 88 and the main electrode 86 with the first projections 90*a*, 90*b*, 90*c* and 90*d* connected to the shaded portions 190*a*, 190*b*, 190*c* and 190*d* of the external electrode 88, respectively and the second projections 94*a*, 94*b*, 94*c* and 94*d* connected to the shaded portions 194*a*, 194*b*, 194*c* and 194*d*, respectively. The composite electrode 38A is so assembled. Consequently, arc current from the current carrying rod 36A flows into the external electrode 88 where it is branched into four currents. The branched current flows along the periphery of the external electrode 88 and then through the first projections 90*a*–90*d* into the arcuate sections 92*a*–92*d*. The branched current, after clockwise flowing through the arcuate sections 92*a*–92*d* enters through the second projections 94*a*–94*d* into the main electrode 86 and flows from there through arc into the associated main electrode. A magnetic field created on the electrode surface of the main electrode 86 by the branched currents flowing through the arcuate sections 92*a*–92*d* is substantially equal to a magnetic field created by causing the branched current to flow through a coil of one turn placed in a position in which the arcuate sections 92*a*–92*d* are located. Straight slits 96 and 100 provided in the external electrode 88 and main electrode 86, respectively, serve to cause electric current flowing through the electrodes 88, 86 to flow in the radial direction of the external electrode 88 and main electrode 86, and decrease the generation of eddy current. In this embodiment, the composite electrode 38A comprises the external electrode 88, main electrode 86 and coil member 93 disposed between the external electrode 88 and the main electrode 86 and consisting of the arcuate sections 92, the first and second projections 90 and 94. Since the coil member 93 is formed separately from the external electrode 88 and main electrode 86, the composite electrode 38A is easily assembled. Where it is desired to vary the intensity of magnetic field, it is only necessary that the coil member 93 and associated members be replaced with desired ones.

Figure 24:
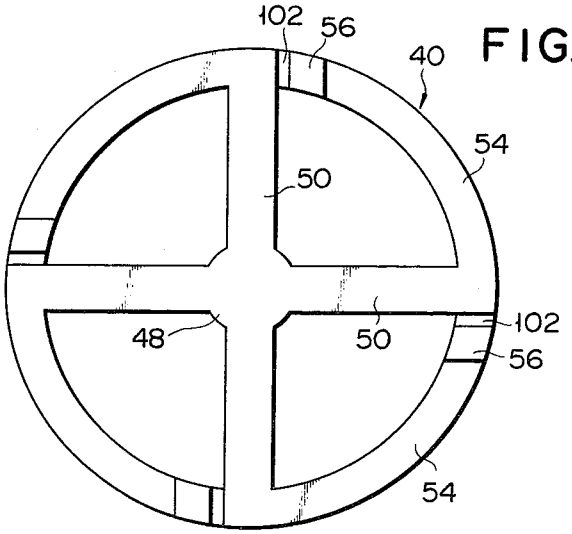
FIG. 24 is a plan view showing a coil electrode with a reinforcing member.
Figure 25:
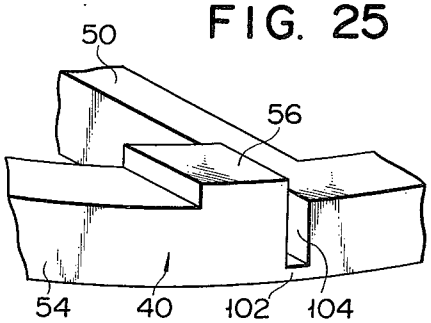
FIG. 25 is a fragmentary perspective view showing the portion of the reinforcing member of FIG. 24.

In the embodiment shown in FIG. 2B, for example, the free end of the arcuate section 54 of the coil electrode 40 is disposed adjacent to the first conductor or arm 50 of the coil electrode with a clearance 52 left therebetween. This provides a weakening spot from the structural viewpoint. In order to reinforce the weakening spot, a reinforced portion 102 (FIG. 24, FIG. 25) is added to the coil electrode 40 shown in FIGS. 3A and 3B. In this embodiment, the free end of the arcuate section 54 is connected through the reinforced portion 102 to the adjacent arm 50, thus reinforcing the coil electrode 40 as a whole. In FIG. 25, the reinforcing portion 102 is shown. The reinforcing portion 102 is provided between the free end of the arcuate section 54 and the forward end of the adjacent arm 50 with a recess 104 left therebetween. Consequently, the reinforcing portion 102 forms a bridge at the bottom of the recess 104. The position, thickness etc. of the reinforcing portion 102 may be suitably selected. since the arcuate section 54 and the adjacent arm 50 are short circuited through the reinforcng portion 102 and, consequently, magnetic field is decreased by that extent, the cross section of the reinforcing portion 102 is determined taking into consideration the decrease of magnetic field and the extent to which the coil electrode 40 is reinforced. Where no intense magnetic field is required, the cross section of the reinforcing portion 102 is made wider so that, even if short-circuit current flows through the reinforcing portion 102, desired magnetic current can be obtained.

The reinforcing portion 102 can be added to the electrode 40 shown in FIGS. 3A and 3B.

Figure 26:
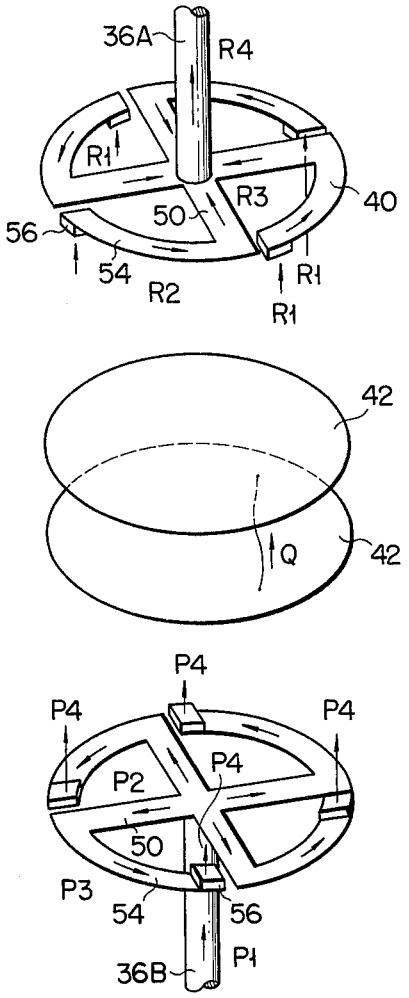
FIG. 26 is an explanatory view showing a pair of composite electrodes located in a desired position.

FIG. 26 shows a positional relation between paired composite electrodes 38A and 38B as shown in FIG. 1A which is effective for forming magnetic field when an interrupter having the composite electrodes 38A and 38B is employed. It has already been explained that magnetic field is created between the associated main electrodes by the branched current flowing through the arcuate section 54 of the coil electrode 40. Since the branched current creates, upon flowing through the arm 50, a magnetomotive force, it is desirable to decrease or cancel the magnetomotive force to maintain magnetic field undisturbed. A simple method for attaining the above-mentioned object will be explained in connection with the composite electrodes shown in FIGS. 2A and 2B. For ease of explanation, in FIG. 26 the coil electrode 40 is shown spaced apart from the main electrode 42, and the slits of the main electrode have been omitted. FIG. 26 shows the case where electric current flows from the current carrying rod 36B into the composite electrode 38B and then through arc Q into the composite electrode 38A and flows away through the current carrying rod 36A. The composite electrodes 38A and 38B are located with the arms 50 of one composite electrode arranged in alignment with the arms 50 of the other composite electrode. Electric current flows through the current carrying rod 36B in the direction of P1 and is branched at the arms 50 of the coil electrode 40 into four currents. The branched current flows through the arms 50 in the direction P2 and then through the arcuate sections 54 of the coil electrode 40 in a counterclockwise direction i.e. in the direction of P3. The current further flows from the arcuate section 54 through the projection 56 in a direction of P4 into the lower main electrode 42, then through arc Q into the associated upper main electrode 42. It flows from the upper main electrode 42 through the projection 56 of the coil electrode 40 in the direction of R1 into the arcuate section 54 of the coil electrode 40. It further flows through the arcuate section 54 in a counterclockwise direction, i.e. in the direction of R2, into the arm 50. After flowing through the arm 50 in the direction of R3, the branched currents meet at the current carrying rod 36A. All the branched currents flowing through the arcuate sections 54 of the composite electrodes 38A and 38B in the counterclockwise direction are cooperated to create a magnetic field. Since the branched current flowing through the arm 50 of the composite electrode 38B is opposite in direction to the branched current flowing through the arm 50 of the composite electrode 38A, the corresponding magnetomotive forces created at the arms 50 of the composite electrodes 38B and 38A cancel each other. As a result, the magnetic field is prevented from being disturbed by these magnetomotive forces.

What we claim is:

1. A vacuum interrupter comprising a vacuum vessel; a pair of current carrying rods arranged in a manner aligned with each other and having one end extending into the interior of the vacuum vessel, at least one of said current carrying rods being axially movable; a pair of main electrodes each connected to the end of one current carrying rod and having a plurality of slits extending from the periphery toward the center thereof; at least one coil electrode connected between one main electrode and the corresponding current carrying rod; the coil electrode comprising a plurality of first conductor arms extending substantially radially from the central portion thereof to permit currents branched from arc current to flow toward the periphery thereof, a plurality of second conductors each arcuately extending in the same direction from the forward end of one of the first conductor arms toward the forward end portion of the adjacent first conductor arm with a space left therebetween, and a plurality of third conductors extending from the free ends of the second conductors and connected to the main electrode; said first, second and third conductors being effective to create a substantially uniformly distributed magnetic field in a direction perpendicular to the electrode surface of the main electrode by the branched currents flowing therethrough; said slits being effective to reduce eddy current to be developed on the surface of the main electrode by the magnetic field, while leading the branched currents on the main electrode to flow through the center portion of the main electrode, thus preventing the magnetic field from being weakened by the eddy current and branched currents.

2. A vacuum interrupter according to claim 1, in which the slits of the main electrode are provided at least one between the third conductors and not spanned with the third conductor.

3. A vacuum interrupter according to claim 1, in which the third conductor is a projection extending from the forward end of the second conductor toward the main electrode.

4. A vacuum interrupter according to claim 1, in which the third conductor consists of an extension extending from the forward end of the second conductor toward the current carrying rod and a projection provided at the free end of the extension and connected to the main electrode.

5. A vacuum interrupter according to claim 1, in which there is further provided at least one reinforcing member made of high resistance material which is disposed at a clearance formed between the main electrode and the coil electrode.

6. A vacuum interrupter according to claim 1, in which there are further provided a plurality of reinforcing portions interconnecting the free end of the second conductor and the forward end portion of the first conductor.

7. A vacuum interrupter according to claim 1, in which one of the current carrying rods is movable and the other unmovable, the coil electrode is provided between the other current carrying rod and the corresponding main electrode.

8. A vacuum interrupter according to claim 1, in which a pair of coil electrodes having the same configuration are connected between the main electrodes and the corresponding current carrying rods and are so arranged that the first conductor arms of one coil electrode are parallel with the first conductor arms of the other coil electrode and the second conductors of one coil electrode extend in a direction opposite to that in which the second conductors of the other coil electrode extend.

* * * * *